US007868549B2

(12) United States Patent
Kim

(10) Patent No.: US 7,868,549 B2
(45) **Date of Patent: *Jan. 11, 2011**

(54) PLASMA DISPLAY PANEL COMPRISING PHOSPHOR ADDITIVE MATERIAL

(75) Inventor: Heekwon Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 263 days.

This patent is subject to a terminal disclaimer.

(21) Appl. No.: 12/046,241

(22) Filed: Mar. 11, 2008

(65) Prior Publication Data

US 2009/0108754 A1 Apr. 30, 2009

(30) Foreign Application Priority Data

Oct. 29, 2007 (KR) ..... 10-2007-0109092

(51) Int. Cl.
*H01J 17/49* (2006.01)

(52) U.S. Cl. ..... 313/586; 313/582; 313/587

(58) Field of Classification Search ..... 313/582–587
See application file for complete search history.

(56) References Cited

U.S. PATENT DOCUMENTS

2003/0090443 A1* 5/2003 Kobayashi ..... 345/60
2004/0168630 A1* 9/2004 Suzuki et al. ..... 118/300
2005/0093450 A1* 5/2005 Yoon ..... 313/586
2005/0110412 A1* 5/2005 Lee ..... 313/587
2006/0103307 A1* 5/2006 Yan et al. ..... 313/582
2006/0175949 A1* 8/2006 Jeong ..... 313/292
2009/0102381 A1* 4/2009 Kim et al. ..... 313/586
2009/0134809 A1* 5/2009 Kim et al. ..... 315/169.4
2009/0140954 A1* 6/2009 Kim et al. ..... 345/68

FOREIGN PATENT DOCUMENTS

JP 2005183206 A * 7/2005

OTHER PUBLICATIONS

Machine Translation Kobayashi et al JP 2005-183206 A.*

* cited by examiner

*Primary Examiner*—Sikha Roy
*Assistant Examiner*—Jose M Diaz
(74) *Attorney, Agent, or Firm*—KED & Associates, LLP

(57) ABSTRACT

A plasma display panel is disclosed. The plasma display panel includes a front substrate on which a scan electrode and a sustain electrode are positioned parallel to each other, a rear substrate on which an address electrode is positioned to intersect the scan and sustain electrodes, a barrier rib positioned between the front and rear substrates to partition a discharge cell, and a phosphor layer that is positioned in the discharge cell and includes a phosphor material and MgO material. At least two scan electrodes are adjacently positioned. The barrier rib includes a first barrier rib positioned parallel to the scan and sustain electrodes, and a second barrier rib intersecting the first barrier rib. A height of the first barrier rib is different from a height of the second barrier rib.

18 Claims, 13 Drawing Sheets

| | Comparative example | Experimental example 1 | Experimental example 2 | Experimental example 3 |
|---|---|---|---|---|
| Firing voltage | 135V | 128V | 129V | 127V |
| Luminance | 170(cd/$m^2$) | 176(cd/$m^2$) | 178(cd/$m^2$) | 177(cd/$m^2$) |
| Contrast ratio | 55:1 | 60:1 | 58:1 | 61:1 |

PLASMA DISPLAY PANEL COMPRISING PHOSPHOR ADDITIVE MATERIAL

This application claims the benefit of Korean Patent Application No. 10-2007-0109092 filed on Oct. 29, 2007, which is hereby incorporated by reference.

BACKGROUND

1. Field

An exemplary embodiment relates to a plasma display panel.

2. Description of the Background Art

A plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light.

SUMMARY

In one aspect, a plasma display panel comprises a front substrate on which a plurality of scan electrodes and a plurality of sustain electrodes are positioned substantially parallel to each other, at least two scan electrodes of the plurality of scan electrodes being adjacently positioned, a rear substrate positioned opposite the front substrate, a barrier rib that is positioned between the front substrate and the rear substrate to partition a discharge cell, and a phosphor layer positioned in the discharge cell, the phosphor layer including a phosphor material and an additive material, the additive material including at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube).

In another aspect, a plasma display panel comprises a front substrate on which a plurality of scan electrodes and a plurality of sustain electrodes are positioned substantially parallel to each other, at least two scan electrodes of the plurality of scan electrodes being adjacently positioned, a rear substrate on which a plurality of address electrodes are positioned to intersect the scan electrodes and the sustain electrodes, a barrier rib that is positioned between the front substrate and the rear substrate to partition a discharge cell, the barrier rib including a first barrier rib positioned substantially parallel to the scan electrode and the sustain electrode and a second barrier rib intersecting the first barrier rib, a height of the first barrier rib being different from a height of the second barrier rib, and a phosphor layer positioned in the discharge cell, the phosphor layer including a phosphor material and an additive material, the additive material including at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube).

In still another aspect, a plasma display panel comprises a front substrate on which a plurality of scan electrodes and a plurality of sustain electrodes are positioned substantially parallel to each other, at least two scan electrodes of the plurality of scan electrodes being adjacently positioned, a rear substrate on which a plurality of address electrodes are positioned to intersect the scan electrodes and the sustain electrodes, a barrier rib that is positioned between the front substrate and the rear substrate to partition a discharge cell, the barrier rib including a first barrier rib positioned substantially parallel to the scan electrode and the sustain electrode and a second barrier rib intersecting the first barrier rib, a height of the first barrier rib being different from a height of the second barrier rib, and a phosphor layer positioned in the discharge cell, the phosphor layer including a phosphor material and MgO material.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION

Reference will now be made in detail embodiments of the invention examples of which are illustrated in the accompanying drawings.

Figure 1:
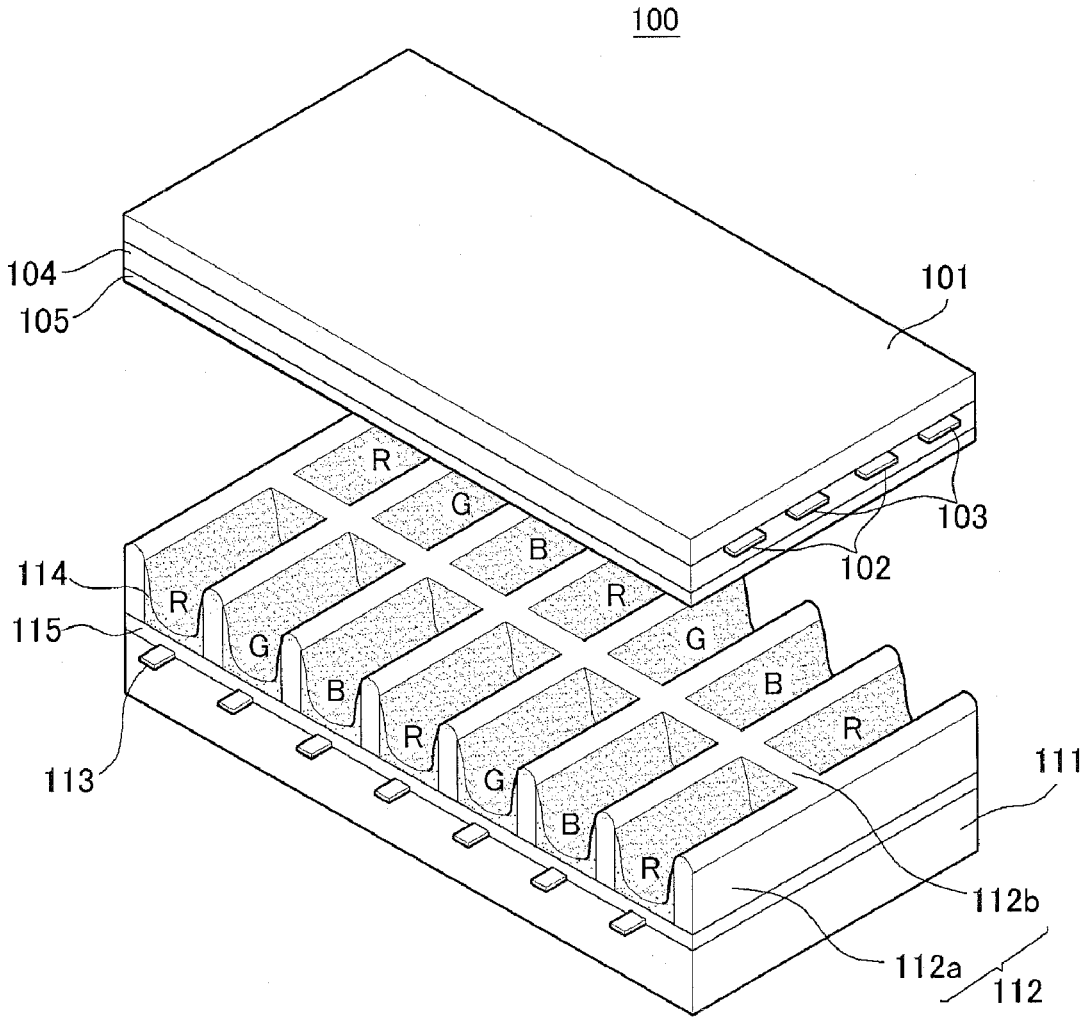
FIG. 1 shows a structure of a plasma display panel according to an exemplary embodiment.

FIG. 1 shows a structure of a plasma display panel according to an exemplary embodiment.

As shown in FIG. 1, a plasma display panel 100 according to an exemplary embodiment may include a front substrate 101, on which a scan electrode 102 and a sustain electrode 103 are positioned parallel to each other, and a rear substrate 111 on which an address electrode 113 is positioned to intersect the scan electrode 102 and the sustain electrode 103.

An upper dielectric layer 104 may be positioned on the scan electrode 102 and the sustain electrode 103 to limit a discharge current of the scan electrode 102 and the sustain electrode 103 and to provide electrical insulation between the scan electrode 102 and the sustain electrode 103.

A protective layer 105 may be positioned on the upper dielectric layer 104 to facilitate discharge conditions. The protective layer 105 may include a material having a high secondary electron emission coefficient, for example, magnesium oxide (MgO).

A lower dielectric layer 115 may be positioned on the address electrode 113 to cover the address electrode 113 and to provide electrical insulation of the address electrodes 113.

Barrier ribs 112 of a stripe type, a well type, a delta type, a honeycomb type, and the like, may be positioned on the lower dielectric layer 115 to partition discharge spaces (i.e., discharge cells). Hence, a first discharge cell emitting red (R) light, a second discharge cell emitting blue (B) light, and a third discharge cell emitting green (G) light, and the like, may be positioned between the front substrate 101 and the rear substrate 111. In addition to the first, second, and third discharge cells, a fourth discharge cell emitting white (W) light or yellow (Y) light may be further positioned.

Widths of the first, second, and third discharge cells may be substantially equal to one another. Further, a width of at least one of the first, second, and third discharge cells may be different from widths of the other discharge cells. For instance, a width of the first discharge cell may be the smallest, and widths of the second and third discharge cells may be larger than the width of the first discharge cell. The width of the second discharge cell may be substantially equal to or different from the width of the third discharge cell. Hence, a color temperature of an image displayed on the plasma display panel 100 can be improved.

The plasma display panel 100 may have various forms of barrier rib structures as well as a structure of the barrier rib 112 shown in FIG. 1. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other, a channel type barrier rib structure in which a channel usable as an exhaust path is formed on at least one of the first barrier rib 112*b* or the second barrier rib 112*a*, a hollow type barrier rib structure in which a hollow is formed on at least one of the first barrier rib 112*b* or the second barrier rib 112*a*, and the like.

In the differential type barrier rib structure, a height of the first barrier rib 112*b* may be smaller than a height of the second barrier rib 112*a*. In the channel type barrier rib structure, a channel may be formed on the first barrier rib 112*b*.

While FIG. 1 has shown and described the case where the first, second, and third discharge cells are arranged on the same line, the first, second, and third discharge cells may be arranged in a different pattern. For instance, a delta type arrangement in which the first, second, and third discharge cells are arranged in a triangle shape may be applicable. Further, the discharge cells may have a variety of polygonal shapes such as pentagonal and hexagonal shapes as well as a rectangular shape.

Each of the discharge cells partitioned by the barrier ribs 112 may be filled with a discharge gas such as argon (Ar), neon (Ne), xenon (Xe), helium (He).

A phosphor layer 114 may be positioned inside the discharge cells to emit visible light for an image display during an address discharge. For instance, first, second, and third phosphor layers that produce red, blue, and green light, respectively, may be positioned inside the discharge cells. In addition to the first, second, and third phosphor layers, a fourth phosphor layer producing white and/or yellow light may be further positioned.

A thickness of at least one of the first, second, and third phosphor layers may be different from thicknesses of the other phosphor layers. For instance, a thickness of the second phosphor layer or the third phosphor layer may be larger than a thickness of the first phosphor layer. The thickness of the second phosphor layer may be substantially equal or different from the thickness of the third phosphor layer.

In FIG. 1, the upper dielectric layer 104 and the lower dielectric layer 115 each have a single-layered structure. However, at least one of the upper dielectric layer 104 or the lower dielectric layer 115 may have a multi-layered structure.

A black layer (not shown) capable of absorbing external light may be further positioned on the barrier rib 112 to prevent the external light from being reflected by the barrier rib 112. Further, another black layer (not shown) may be further positioned at a predetermined location of the front substrate 101 to correspond to the barrier rib 112.

While the address electrode 113 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

Figure 2:
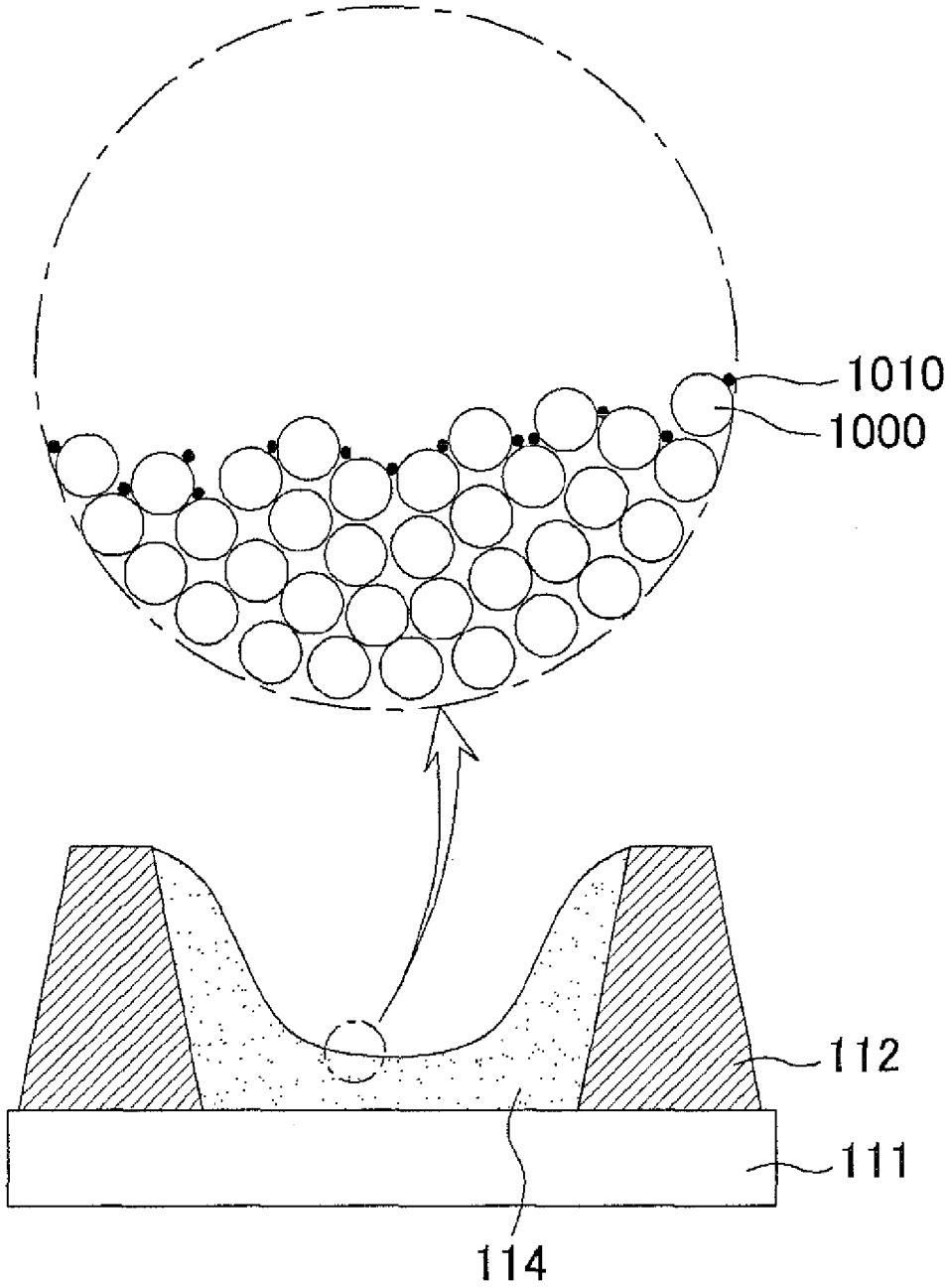
FIG. 2 shows a phosphor layer.

FIG. 2 shows a phosphor layer.

As shown in FIG. 2, the phosphor layer 114 includes particles 1000 of a phosphor material and particles 1010 of an additive material.

The particles 1010 of the additive material can improve a discharge response characteristic between the scan electrode and the address electrode or between the sustain electrode and the address electrode. This will be below described in detail.

When a scan signal is supplied to the scan electrode and a data signal is supplied to the address electrode, charges may be accumulated on the surface of the particles 1000 of the phosphor material.

If the phosphor layer 114 does not include an additive material, charges may be concentratedly accumulated on a specific portion of the phosphor layer 114 because of the nonuniform height of the phosphor layer 114 and the nonuniform distribution of the particles of the phosphor material. Hence, a relatively strong discharge may occur in the specific portion of the phosphor layer 114 on which charges are concentratedly accumulated.

Further, charges may be concentratedly accumulated in a different area of each discharge cell, and thus a discharge may occur unstably and nonuniformly. In this case, the image quality of a displayed image may worsen, and thus a viewer may watch a noise such as spots.

On the other hand, in case that the phosphor layer 114 includes the additive material such as MgO as in the exemplary embodiment, the additive material acts as a catalyst of a discharge. Hence, a discharge can stably occur between the scan electrode and the address electrode at a relatively low voltage. Accordingly, before the strong discharge occurs at a relatively high voltage in the specific portion of the phosphor layer 114, on which charges are concentratedly accumulated, a discharge can occur at a relatively low voltage in a portion of the phosphor layer 114, on which the particles of the additive material are positioned. Hence, discharge characteristics of each discharge cell can be uniform. This is caused by a reason why the additive material has a high secondary electron emission coefficient.

The additive material is not limited particularly except the improvement of the discharge response characteristic between the scan electrode and the address electrode or between the sustain electrode and the address electrode. Examples of the additive material include at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube). It may be advantageous that the additive material is MgO.

At least one of the particles 1000 of the phosphor material on the surface of the phosphor layer 114 may be exposed in a direction toward the center of the discharge cell. For instance, since the particles 1010 of the additive material are disposed between the particles 1000 of the phosphor material on the surface of the phosphor layer 114, at least one particle 1000 of the phosphor material may be exposed.

As described above, when the particles 1010 of the additive material are disposed between the particles 1000 of the phosphor material, a discharge response characteristic between the scan electrode and the address electrode or between the sustain electrode and the address electrode can be improved. Further, since the surface area of the particles 1000 of the phosphor material covered by the particles 1010 of the additive material may be minimized, an excessive reduction in a luminance can be prevented.

Although it is not shown, if the particles 1010 of the additive material are uniformly coated on the surface of the phosphor layer 114, and a layer formed of the additive material is formed on the surface of the phosphor layer 114, the additive layer covers the most of the surface of the particles 1000 of the phosphor material. Hence, a luminance may be excessively reduced.

Figures 3, 4:
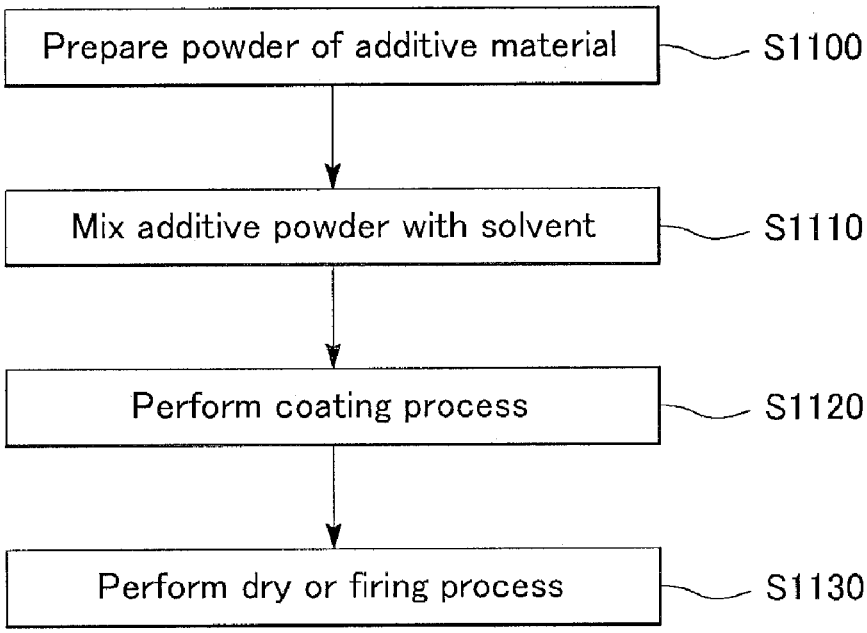
FIG. 3 illustrates an example of a method of manufacturing a phosphor layer.
FIGS. 4 and 5 are diagrams for explaining an effect of an additive material.

FIG. 3 illustrates an example of a method of manufacturing a phosphor layer.

As shown in FIG. 3, first, a powder of an additive material is prepared in step S1100. For instance, a gas oxidation process is performed on Mg vapor generated by heating Mg to form a powder of MgO.

Next, the prepared additive power is mixed with a solvent in step S1110. For instance, the resulting MgO powder is mixed with methanol to manufacture an additive paste or an additive slurry. A binder may be added so as to adjust a viscosity of the additive paste or the additive slurry.

Subsequently, the additive paste or slurry is coated on the phosphor layer in step S1120. In this case, a viscosity of the additive paste or the additive slurry is adjusted so that the particles of the additive material are smoothly positioned between the particles of the phosphor material.

Subsequently, a dry process or a firing process is performed in step S1130. Hence, the solvent mixed with the additive material is evaporated to form the phosphor layer of FIG. 2.

Figure 5:
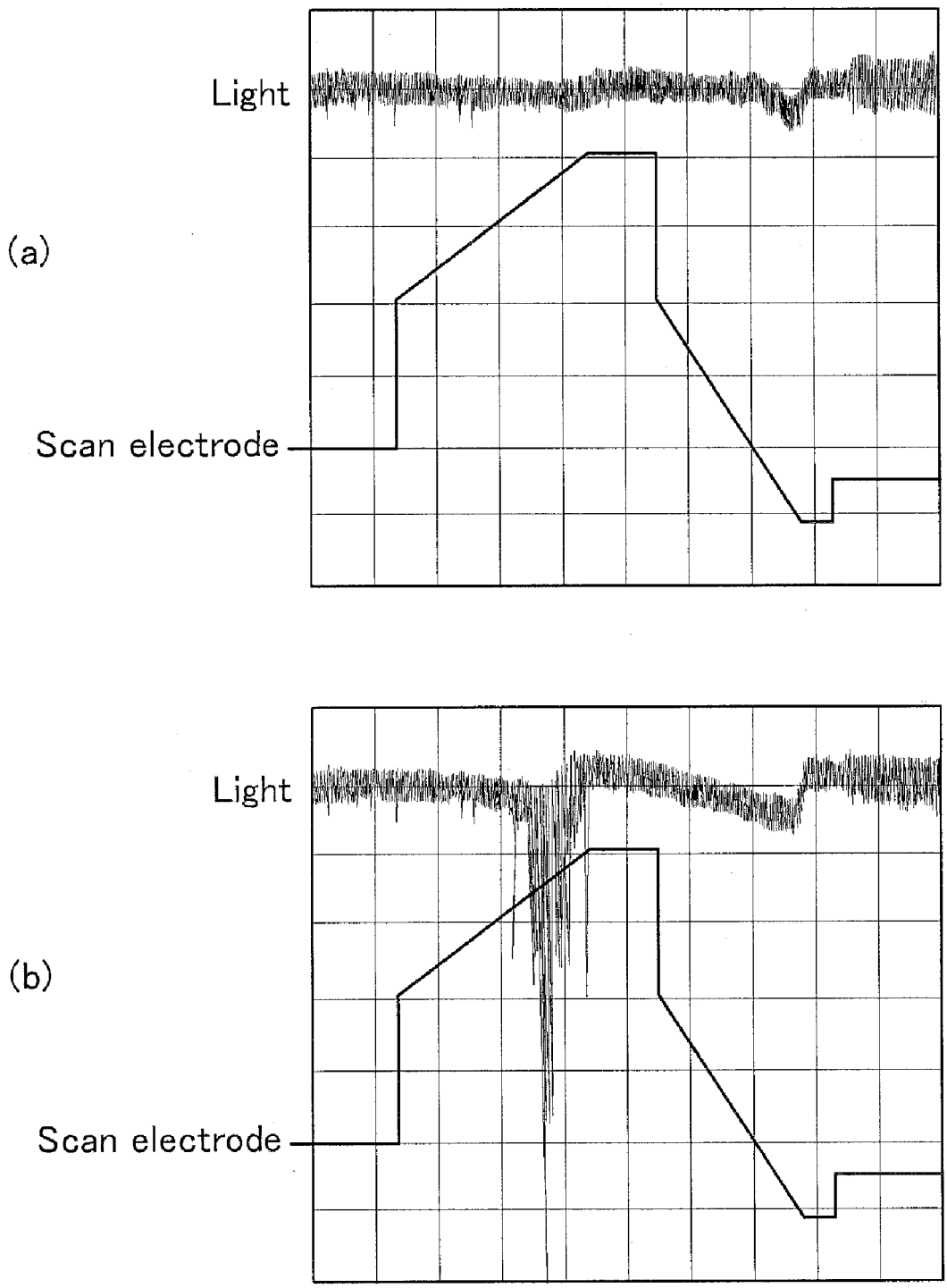

FIGS. 4 and 5 are diagrams for explaining an effect of an additive material.

FIG. 4 is a table showing a firing voltage, a luminance of a displayed image, and a bright room contrast ratio of each of a comparative example and experimental examples 1, 2 and 3. The bright room contrast ratio measures a contrast ratio in a state where an image with a window pattern occupying 45% of the screen size is displayed in a bright room. The firing voltage is a firing voltage measured between the scan electrode and the address electrode.

In the comparative example, the phosphor layer does not include an additive material.

In the experimental example 1, the phosphor layer includes MgO of 3% based on the volume of the phosphor layer as an additive material.

In the experimental example 2, the phosphor layer includes MgO of 9% based on the volume of the phosphor layer as an additive material.

In the experimental example 3, the phosphor layer includes MgO of 12% based on the volume of the phosphor layer as an additive material.

In the comparative example, the firing voltage is 135V, and the luminance is 170 cd/m$^2$.

In the experimental examples 1, 2 and 3, the firing voltage is 127V to 129V lower than the firing voltage of the comparative example, and the luminance is 176 cd/m$^2$ to 178 cd/m$^2$ higher than the luminance of the comparative example. Because the particles of the MgO material as the additive material in the experimental examples 1, 2 and 3 act as a catalyst of a discharge, the firing voltage between the scan electrode and the address electrode is lowered. Furthermore, in the experimental examples 1, 2 and 3, because an intensity of a discharge generated at the same voltage as the comparative example increases due to a fall in the firing voltage, the luminance further increases.

While the bright room contrast ratio of the comparative example is 55:1, the bright room contrast ratio of the experimental examples 1, 2 and 3 is 58:1 to 61:1. As can be seen from FIG. 4, a contrast characteristic of the experimental examples 1, 2 and 3 is more excellent than that of the comparative example.

In the experimental examples 1, 2 and 3, a uniform discharge occurs at a lower firing voltage than that of the comparative example, and thus the quantity of light during a reset period is relatively small in the experimental examples 1, 2 and 3.

In FIG. 5, (a) is a graph showing the quantity of light in the experimental examples 1, 2 and 3, and (b) is a graph showing the quantity of light in the comparative example.

As shown in (b) of FIG. 5, because an instantaneously strong discharge occurs at a relatively high voltage in the comparative example not including the MgO material, the quantity of light may instantaneously increase. Hence, the contrast characteristics may worsen.

As shown in (a) of FIG. 5, because a discharge occurs at a relatively low voltage in the experimental examples 1, 2 and 3 including the MgO material, a weak reset discharge continuously occurs during a reset period. Hence, a small quantity of light is generated, and the contrast characteristics can be improved.

Figure 6:
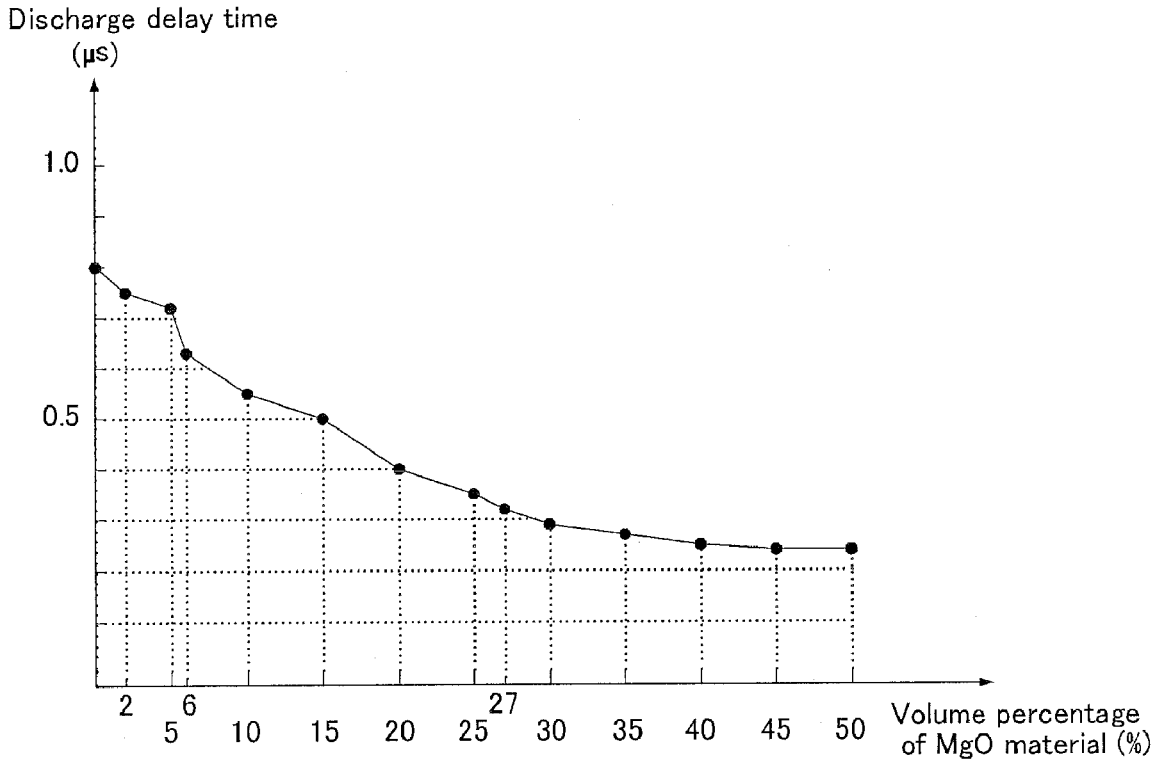
FIG. 6 is a diagram for explaining a content of an additive material.

FIG. 6 is a graph measuring a discharge delay time of an address discharge while a percentage of a volume of MgO material used as an additive material based on the volume of the phosphor layer changes from 0% to 50%.

The address discharge delay time means a time interval between a time when the scan signal and the data signal are supplied during an address period and a time when an address discharge occurs between the scan electrode and the address electrode.

As shown in FIG. 6, when the volume percentage of the MgO material is 0 (in other words, when the phosphor layer does not include MgO material), the discharge delay time may be approximately 0.8 μs.

When the volume percentage of the MgO material is 2%, the discharge delay time is reduced to be approximately 0.75 μs. In other words, because the particles of the MgO material improve a discharge response characteristic between the scan electrode and the address electrode, an address jitter characteristic can be improved.

Further, when the volume percentage of the MgO material is 5%, the discharge delay time may be approximately 0.72 μs. When the volume percentage of the MgO material is 6%, the discharge delay time may be approximately 0.63 μs.

When the volume percentage of the MgO material lies in a range between 10% and 50%, the discharge delay time may be reduced from approximately 0.55 μs to 0.24 μs.

It can be seen from the graph of FIG. 6 that as a content of the MgO material increases, the discharge delay time can be reduced. Hence, the address jitter characteristic can be improved. However, an improvement width of the address jitter characteristic may gradually decrease. In case that the volume percentage of the MgO material is equal to or more than 40%, a reduction width of the discharge delay time may be small.

On the other hand, in case that the volume percentage of the MgO material is excessively large, the particles of the MgO material may excessively cover the surface of the particles of the phosphor material. Hence, a luminance may be reduced.

Accordingly, the percentage of the volume of the MgO material based on the volume of the phosphor layer may lie substantially in a range between 2% and 40% or between 6% and 27% so as to reduce the discharge delay time and to prevent an excessive reduction in the luminance.

Figure 7:
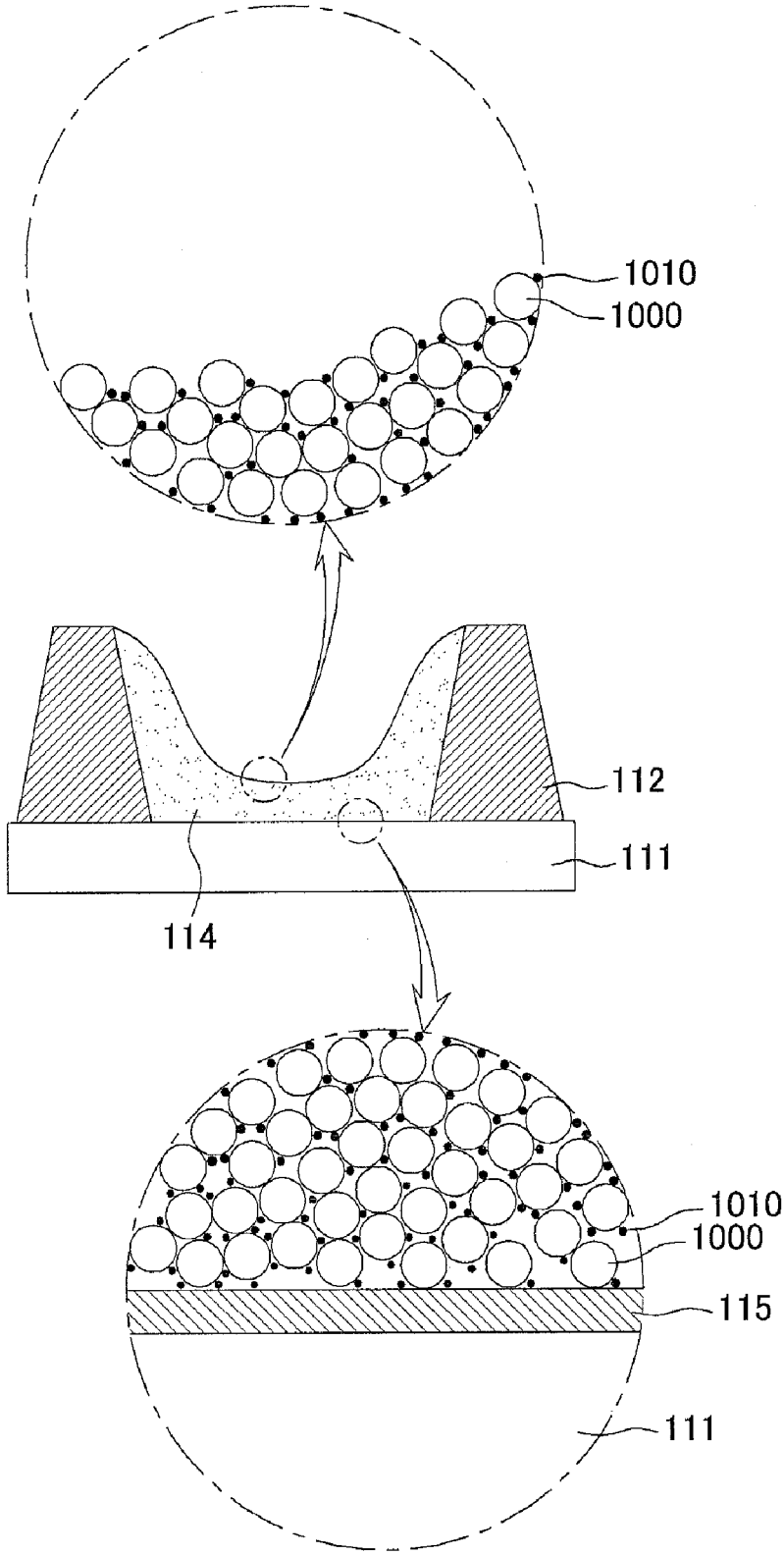
FIG. 7 shows another structure of a phosphor layer.

FIG. 7 shows another structure of a phosphor layer.

As shown in FIG. 7, the particles 1010 of the additive material may be positioned on the surface of the phosphor layer 114, inside the phosphor layer 114, and between the phosphor layer 114 and the lower dielectric layer 115.

When the particles 1010 of the additive material may be positioned on the surface of the phosphor layer 114, inside the phosphor layer 114, and between the phosphor layer 114 and the lower dielectric layer 115, a discharge response characteristic between the scan electrode and the address electrode or between the sustain electrode and the address electrode can be improved.

Figure 8:
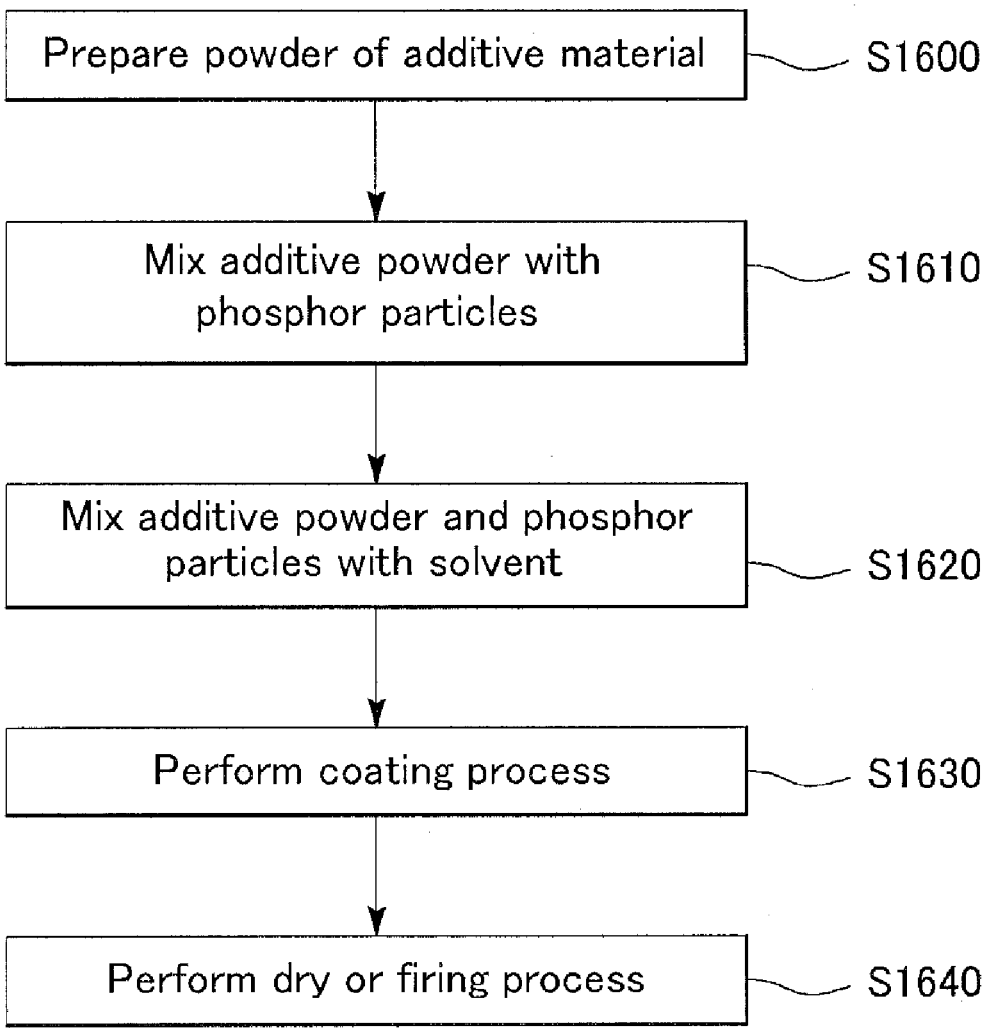
FIG. 8 illustrates an example of a method of manufacturing a phosphor layer of FIG. 7.

FIG. 8 illustrates an example of a method of manufacturing the phosphor layer having the structure shown in FIG. 7.

As shown in FIG. 8, a powder of an additive material is prepared in step S1600.

The prepared additive power is mixed with phosphor particles in step S1610.

The additive power and the phosphor particles are mixed with a solvent in step S1620.

The additive power and the phosphor particles mixed with the solvent are coated inside the discharge cells in step S1630. In the coating process, a dispensing method may be used.

A dry process or a firing process is performed in step S1640 to evaporate the solvent. Hence, the phosphor layer having the structure shown in FIG. 7 is formed.

Figure 9:
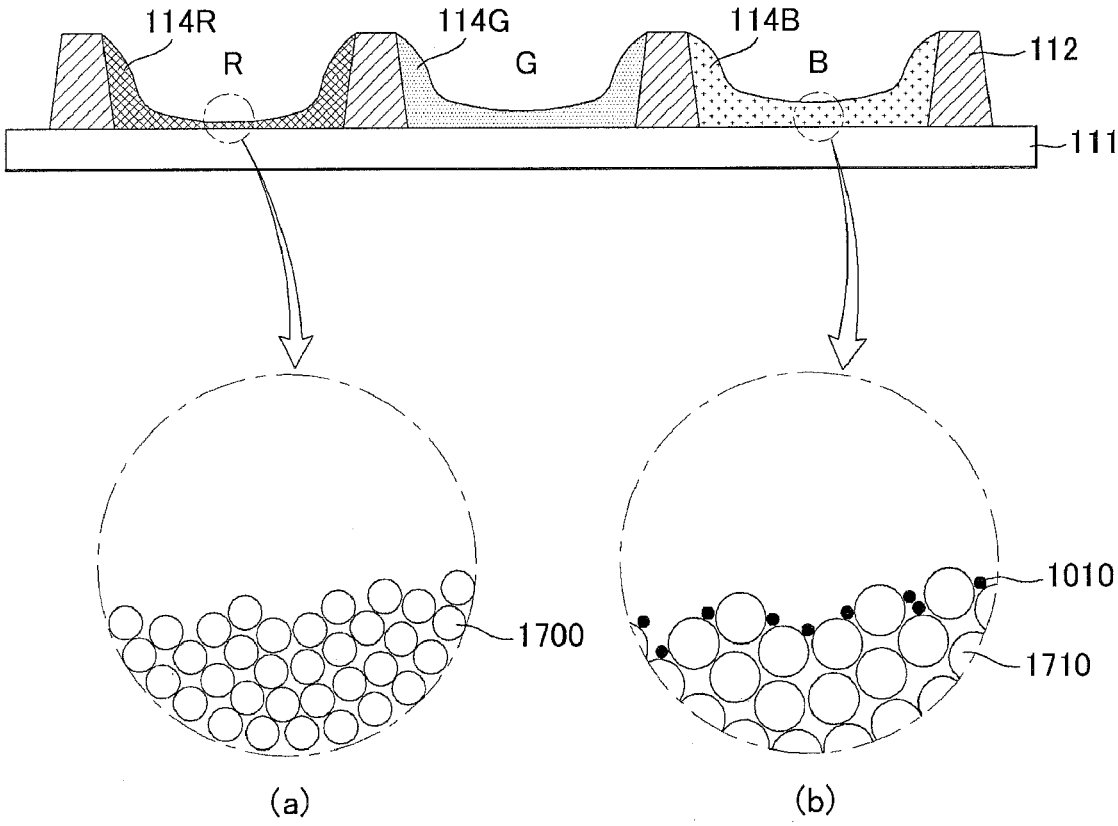
FIG. 9 is a diagram for explaining a method of selectively using an additive material.

FIG. 9 is a diagram for explaining a method of selectively using an additive material.

As shown in FIG. 9, the phosphor layer includes a first phosphor layer 114R emitting red light, a second phosphor layer 114B emitting blue light, and a third phosphor layer 114G emitting green light. At least one of the first phosphor layer 114R, the second phosphor layer 114B, or the third phosphor layer 114G may not include the additive material.

For instance, as shown in (a), the first phosphor layer 114R includes particles 1700 of a first phosphor material, but does not include an additive material. As shown in (b), the second phosphor layer 114B includes particles 1710 of a second phosphor material and particles 1010 of an additive material. In this case, the quantity of light generated in the second phosphor layer 114B can increase, and thus a color temperature can be improved.

The size of the particles 1710 of the second phosphor material in (b) may be larger than the size of the particles 1700 of the first phosphor material in (a). In this case, a discharge in the second phosphor layer 114B in (b) may be more unstable than a discharge in the first phosphor layer 114R in (a). However, because the second phosphor layer 114B includes the particles 1010 of the additive material, the discharge in the second phosphor layer 114B can be stabilized.

The particles of the MgO material included in the phosphor layer may have one orientation or two or more different orientations. For instance, only (200)-oriented MgO material may be used, or (200)- and (111)-oriented MgO material may be used. However, (200)-oriented MgO material and (111)-oriented MgO material may be together used so as to improve a discharge response characteristic between the scan electrode and the address electrode or between the sustain electrode and the address electrode and to prevent the degradation of the phosphor layer.

For instance, while the (111)-oriented MgO material has a relatively higher secondary electron emission coefficient than the (200)-oriented MgO material, the (111)-oriented MgO material has a relatively weaker sputter resistance than the (200)-oriented MgO material. Further, wall charges accumulating characteristic of the (111)-oriented MgO material is weaker than that of the (200)-oriented MgO material.

Accordingly, in case that only the (111)-oriented MgO material is used, it is possible to improve a discharge response characteristic between the scan electrode and the address electrode or between the sustain electrode and the address electrode. However, it is difficult to prevent the degradation of the phosphor layer.

On the other hand, in case that only the (200)-oriented MgO material is used, it is possible to prevent the degradation of the phosphor layer. However, it is difficult to improve a discharge response characteristic between the scan electrode and the address electrode or between the sustain electrode and the address electrode.

Accordingly, the (200)-oriented MgO material and the (111)-oriented MgO material may be together used so as to improve the discharge response characteristic between the scan electrode and the address electrode or between the sustain electrode and the address electrode and to prevent the degradation of the phosphor layer.

In case that the phosphor layer includes the MgO material, the amount of charges accumulated on the surface of the phosphor layer may increase. As a result, the degradation of the phosphor particles may be accelerated. Accordingly, a content of the (200)-oriented MgO material having the relatively stronger sputter resistance may be more than a content of the (111)-oriented MgO material, so as to prevent the degradation of the phosphor particles.

As described above, in case that the phosphor layer includes the additive material, it is possible to improve the discharge response characteristic between the scan electrode and the address electrode or between the sustain electrode and the address electrode, but an occurrence possibility of crosstalk may increase due to an increase in the amount of charges inside the discharge cells.

More specifically, in case that the phosphor layer includes the additive material, the amount of charges inside the discharge cells increases, and thus the movement of charges between the adjacent discharge cells can be accelerated. As a result, a crosstalk phenomenon, in which a discharge occurs in the discharge cell to which a data signal is not supplied, may occur.

It may be advantageous that at least two scan electrodes of the plurality of scan electrodes are adjacently positioned so as to prevent the crosstalk.

Figure 10:
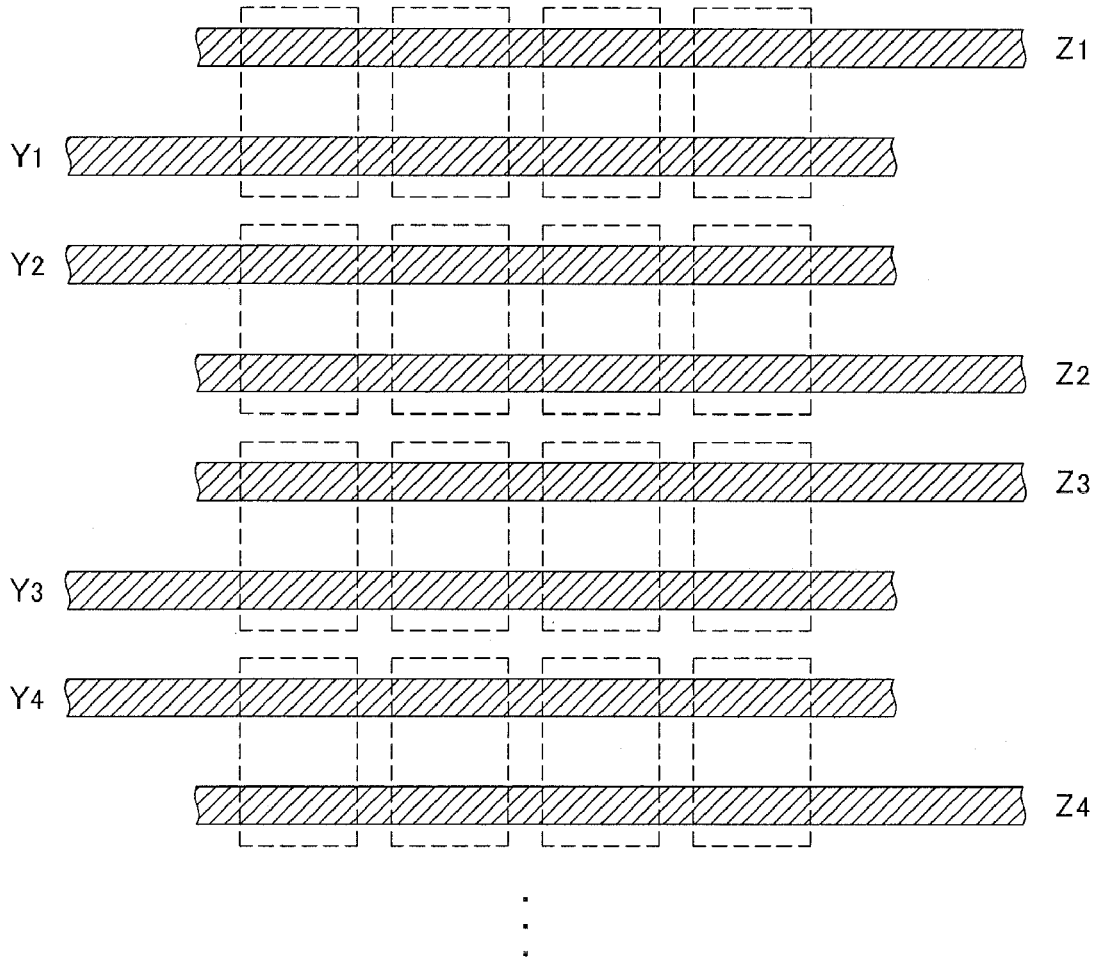
FIG. 10 shows an arrangement structure of a scan electrode and a sustain electrode.

FIG. 10 shows an arrangement structure of a scan electrode and a sustain electrode.

At least two scan electrodes of the plurality of scan electrodes Y1 to Y4 may be adjacently positioned. It may be advantageous that the two scan electrodes are adjacently positioned and the two sustain electrodes are adjacently positioned. For instance, as shown in FIG. 10, the two scan electrodes Y1 and Y2 may be adjacently positioned, the two scan electrodes Y3 and Y4 may be adjacently positioned, and the two sustain electrodes Z2 and Z3 may be adjacently positioned.

Figure 11:
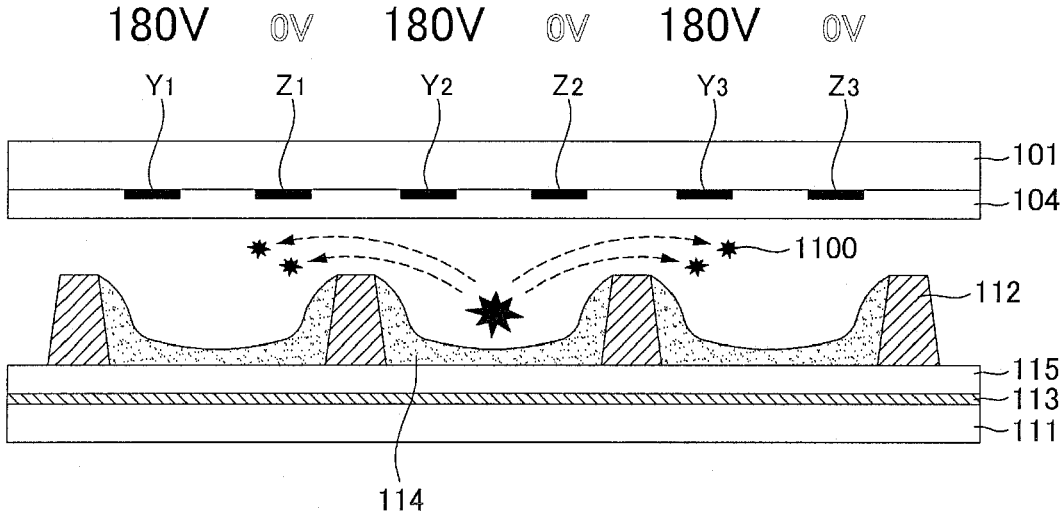
FIGS. 11 and 12 are diagrams for explaining an occurrence of crosstalk.

FIG. 11 shows an arrangement structure in which the scan electrode and the sustain electrode are alternately positioned. For instance, the scan electrodes Y1, Y2, and Y3 and the sustain electrodes Z1, Z2, and Z3 may be alternately positioned.

In FIG. 11, supposing that a sustain signal having a voltage of 180V is supplied to the scan electrodes and 0V is supplied to the sustain electrodes.

In this case, a movement of charges 1100 between the adjacent discharge cells may briskly occurs. For instance, in case that a sustain discharge occurs between the scan electrode Y2 and the sustain electrode Z2, a voltage difference of 180V occurs between the sustain electrode Z2 and the scan electrode Y3 and between the scan electrode Y2 and the sustain electrode Z1. The scan electrode Y3 or the sustain electrode Z1 attracts the charges 1100 generated by the sustain discharge between the scan electrode Y2 and the sustain electrode Z2, and thus the charges 1100 move to the discharge cell adjacent to the discharge cell where the sustain discharge occurs. As a result, a sustain discharge may occur between the scan electrode Y1 and the sustain electrode Z1 or between the scan electrode Y3 and the sustain electrode Z3. In other words, the crosstalk occurs.

Figure 12:
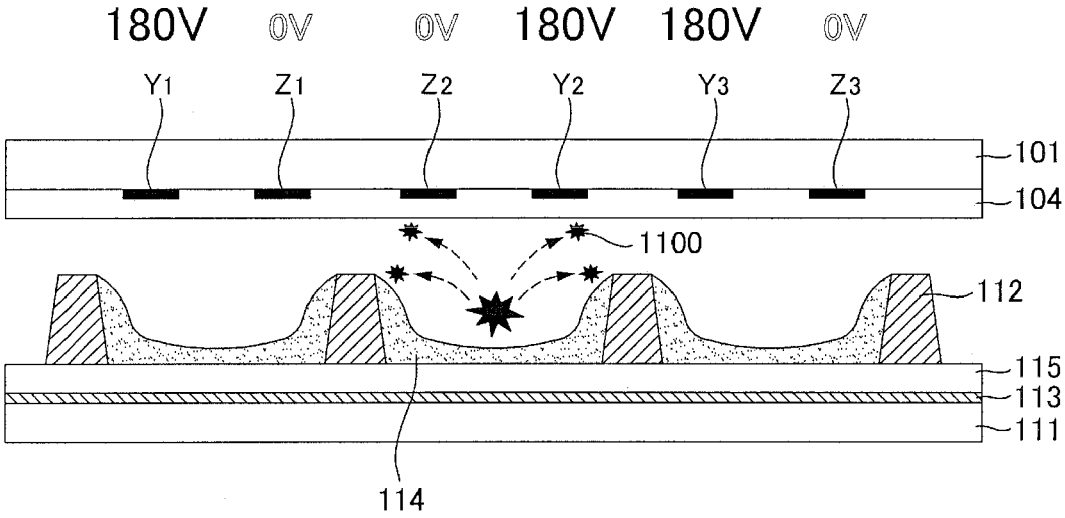

FIG. 12 shows an arrangement structure in which the two scan electrodes are adjacently positioned. In FIG. 12, supposing that a sustain signal having a voltage of 180V is supplied to the scan electrodes and 0V is supplied to the sustain electrodes.

In case that a sustain discharge occurs between the scan electrode Y2 and the sustain electrode Z2, a voltage difference of 0V occurs between the sustain electrode Z2 and the sustain electrode Z1 and between the scan electrode Y2 and the scan electrode Y3. Because a voltage difference does not occur between the adjacent discharge cells, a movement of charges 1100 is suppressed. Hence, the crosstalk can be suppressed.

Figure 13:
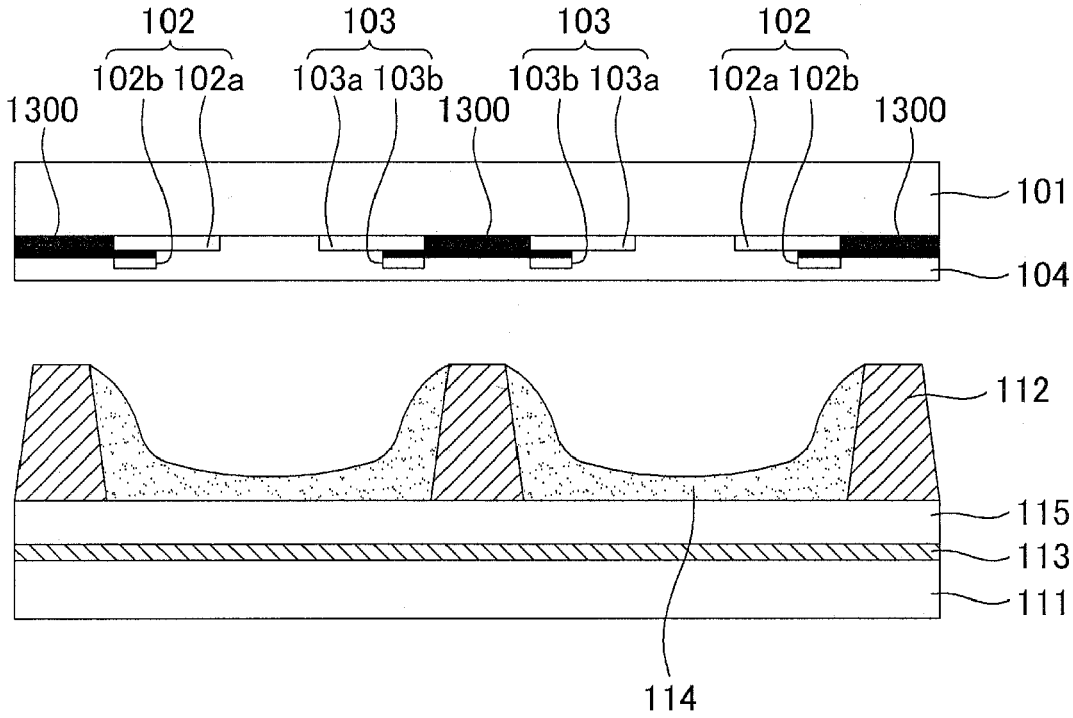
FIG. 13 is a diagram for explaining a common black layer.

FIG. 13 is a diagram for explaining a common black layer.

As shown in FIG. 13, a common black layer 1300 may be positioned between the two adjacently positioned scan electrodes 102 or between the two adjacently positioned sustain electrodes 103. The common black layer 1300 may be connected to each of the two adjacently positioned scan electrodes 102 or to each of the two adjacently positioned sustain electrodes 103.

Each of the scan electrode 102 and the sustain electrode 103 may include transparent electrodes 102*a* and 103*a* and bus electrodes 102*b* and 103*b*. The transparent electrodes 102*a* and 103*a* may include a substantially transparent material having electrical conductivity such as indium-tin-oxide (ITO). The bus electrodes 102*b* and 103*b* may include a metal material having excellent electrical conductivity such as Ag.

The common black layer 1300 may include a portion positioned between the transparent electrodes 102*a* and 103*a* and the bus electrodes 102*b* and 103*b*. The common black layer 1300 is positioned at a location corresponding to the barrier rib 112 to prevent light from being reflected by the barrier rib 112. Hence, the contrast characteristic can be improved.

Figure 14:
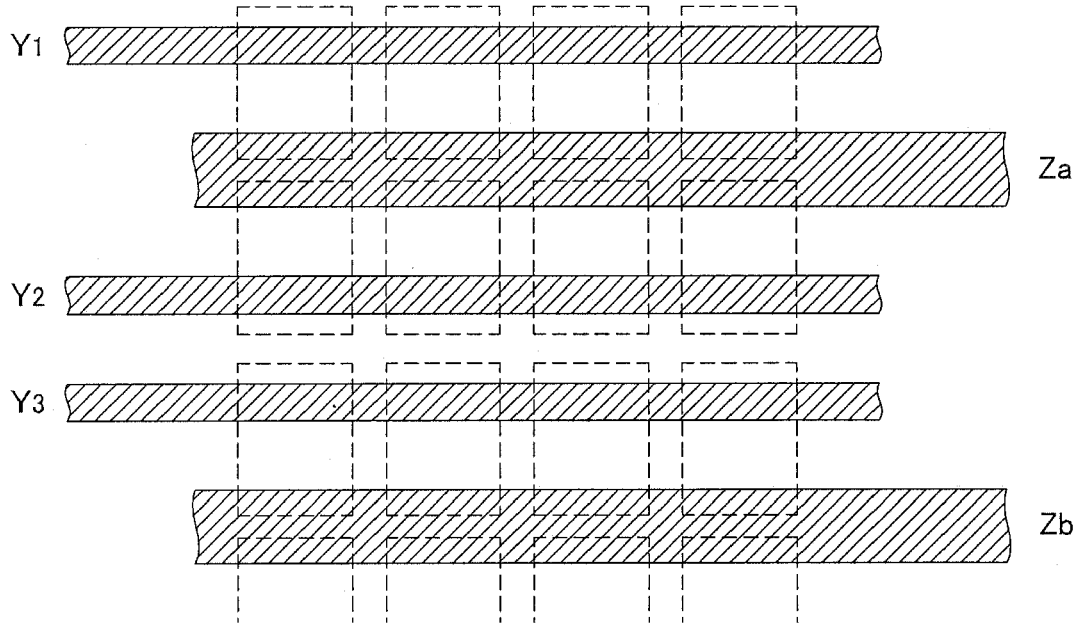
FIGS. 14 and 15 are diagrams for explaining a common sustain electrode.
Figure 15:
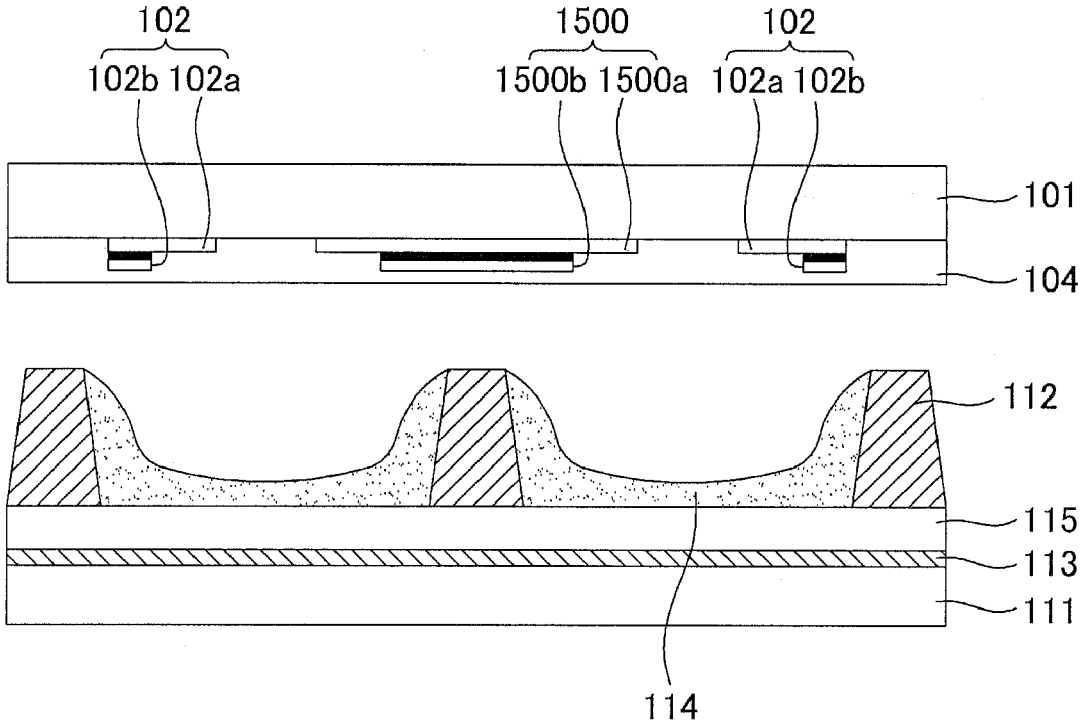

FIGS. 14 and 15 are diagrams for explaining a common sustain electrode.

As shown in FIG. 14, at least two scan electrodes are adjacently positioned, and one common sustain electrode may correspond to the two scan electrodes. For instance, the scan electrode Y1 corresponds to a common sustain electrode Za inside one discharge cell, and the scan electrode Y2 corresponds to the common sustain electrode Za inside another discharge cell.

As shown in FIG. 15, a common sustain electrode 1500 may include a common transparent electrode 1500*a* and a common bus electrode 1500*b*. As above, the common sustain electrode 1500 can reduce an electrical resistance, and thus a driving efficiency can be improved.

Figure 16:
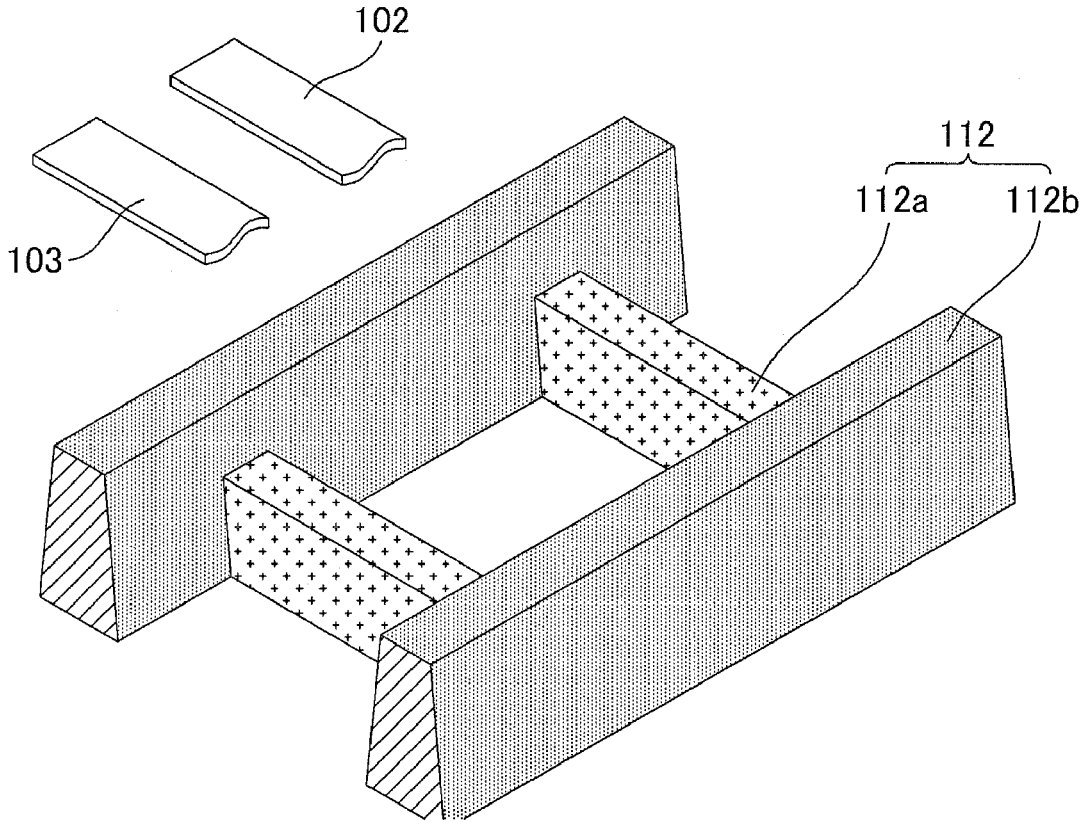
FIG. 16 is a diagram for explaining a barrier rib.

FIG. 16 is a diagram for explaining a barrier rib.

As shown in FIG. 16, the barrier rib 112 may include a first barrier rib 112*a* positioned substantially parallel to the scan electrode 102 and the sustain electrode 103, and a second barrier rib 112*b* intersecting the first barrier rib 112*a*. A height of the first barrier rib 112*a* may be different from a height of the second barrier rib 112*b*.

Considering that the phosphor layer is formed in an intersection direction of the scan electrode 102 and the sustain electrode 103, the height of the first barrier rib 112*a* may be smaller than the height of the second barrier rib 112*b*.

In case that the height of the first barrier rib 112*a* is different from the height of the second barrier rib 112*b*, charges can more easily move between the adjacent discharge cells. Hence, the crosstalk may increase.

Accordingly, in case that the barrier rib 112 includes the first barrier rib 112*a* and the second barrier rib 112*b* each having a different height, the crosstalk can be suppressed by adjacently positioning at least two scan electrodes.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel comprising:

a front substrate on which a plurality of scan electrodes and a plurality of sustain electrodes are positioned substantially parallel to each other, and at least two scan electrodes of the plurality of scan electrodes are adjacently positioned;

a rear substrate positioned opposite the front substrate;

a barrier rib that is positioned between the front substrate and the rear substrate to partition a discharge cell; and a phosphor layer positioned in the discharge cell, the phosphor layer including a phosphor material and an additive material, the additive material including magnesium oxide (MgO), wherein the MgO includes (200)-oriented MgO and (111)-oriented MgO, and a content of the (111)-oriented MgO is less than a content of the (200)-oriented MgO.

2. The plasma display panel of claim 1, wherein two sustain electrodes of the plurality of sustain electrodes are adjacently positioned.

3. The plasma display panel of claim 1, wherein at least one of particles of the additive material is positioned on a surface of the phosphor layer.

4. The plasma display panel of claim 1, further comprising a lower dielectric layer between the phosphor layer and the barrier rib and the rear substrate, wherein at least one particle of the additive material is positioned between the phosphor layer and the lower dielectric layer.

5. The plasma display panel of claim 1, wherein a percentage of a volume of the additive material based on a volume of the phosphor layer lies substantially in a range between 2% and 40%.

6. The plasma display panel of claim 1, wherein the phosphor layer includes a first phosphor layer emitting red light, a second phosphor layer emitting blue light, and a third phosphor layer emitting green light, and the additive material is omitted in at least one of the first phosphor layer, the second phosphor layer, or the third phosphor layer.

7. The plasma display panel of claim 1, wherein a common black layer is positioned between the two adjacently positioned scan electrodes to be connected to each of the two adjacently positioned scan electrodes.

8. A plasma display panel comprising:

a front substrate on which a plurality of scan electrodes and a plurality of sustain electrodes are positioned substantially parallel to each other, and at least two scan electrodes of the plurality of scan electrodes are adjacently positioned;

a rear substrate on which a plurality of address electrodes are positioned to intersect the scan electrodes and the sustain electrodes;

a barrier rib that is positioned between the front substrate and the rear substrate to partition a discharge cell, the barrier rib including a first barrier rib positioned substantially parallel to the scan electrode and the sustain electrode and a second barrier rib intersecting the first barrier rib, a height of the first barrier rib being different from a height of the second barrier rib; and a phosphor layer positioned in the discharge cell, the phosphor layer including a phosphor material and an additive material, the additive material including magnesium oxide (MgO), wherein in case of MgO being included in the additive material, the MgO includes (200)-oriented MgO material and (111)-oriented MgO material and a content of the (111)-oriented MgO material is less than a content of the (200)-oriented MgO material.

9. The plasma display panel of claim 8, wherein the height of the first barrier rib is less than the height of the second barrier rib.

10. The plasma display panel of claim 8, wherein two sustain electrodes of the plurality of sustain electrodes are adjacently positioned.

11. The plasma display panel of claim 8, wherein at least one particle of the additive material is positioned on a surface of the phosphor layer.

12. The plasma display panel of claim 8, further comprising a lower dielectric layer between the phosphor layer and the barrier rib and the rear substrate, wherein at least one particle of the additive material is positioned between the phosphor layer and the lower dielectric layer.

13. The plasma display panel of claim 8, wherein a percentage of a volume of the additive material based on a volume of the phosphor layer lies substantially in a range between 2% and 40%.

14. The plasma display panel of claim 8, wherein the phosphor layer includes a first phosphor layer emitting red light, a second phosphor layer emitting blue light, and a third phosphor layer emitting green light, and the additive material is omitted in at least one of the first phosphor layer, the second phosphor layer, or the third phosphor layer.

15. The plasma display panel of claim 8, wherein a common black layer is positioned between the two adjacently positioned scan electrodes to be connected to each of the two adjacently positioned scan electrodes.

16. A plasma display panel comprising:

a front substrate on which a plurality of scan electrodes and a plurality of sustain electrodes are positioned substantially parallel to each other, and at least two scan electrodes of the plurality of scan electrodes are adjacently positioned;

a rear substrate on which a plurality of address electrodes are positioned to intersect the scan electrodes and the sustain electrodes;

a barrier rib that is positioned between the front substrate and the rear substrate to partition a discharge cell, the barrier rib including a first barrier rib positioned substantially parallel to the scan electrode and the sustain electrode and a second barrier rib intersecting the first barrier rib, a height of the first barrier rib being different from a height of the second barrier rib; and a phosphor layer positioned in the discharge cell, the phosphor layer including a phosphor material and magnesium oxide (MgO), wherein the MgO includes (200)-oriented MgO and (111)-oriented MgO, and a content of the (111)-oriented MgO is less than a content of the (200)-oriented MgO.

17. The plasma display panel of claim 16, wherein the height of the first barrier rib is less than the height of the second barrier rib.

18. The plasma display panel of claim 16, wherein a common black layer is positioned between the two adjacently positioned scan electrodes to be connected to each of the two adjacently positioned scan electrodes.

* * * * *